US005870779A

United States Patent [19]

Heron

[11] Patent Number: 5,870,779

[45] Date of Patent: Feb. 16, 1999

[54] UNDERGARMENT WITH A TESTICLE POUCH AND GENITAL SPACE

[76] Inventor: Rodney Heron, 355 NW. 29th Ave., Fort Lauderdale, Fla. 33311

[21] Appl. No.: 19,168

[22] Filed: Feb. 5, 1998

[51] Int. Cl.[6] ..... A41B 9/02; A61F 13/00

[52] U.S. Cl. ..... 2/403; 2/400; 602/70; 602/71; 602/73

[58] Field of Search ..... 2/400, 403, 405; 602/67–73

[56] References Cited

U.S. PATENT DOCUMENTS

| | | | |
|---|---|---|---|
| 1,592,732 | 7/1926 | Friedman | 602/71 |
| 2,050,410 | 8/1936 | Baer | 602/71 |
| 2,254,863 | 9/1941 | Weihe | 602/71 |
| 3,037,503 | 6/1962 | Ravaschieri | 602/71 |
| 3,499,443 | 3/1970 | Scheerer | 602/71 |
| 5,647,065 | 7/1997 | Richerson | 2/403 |
| 5,784,723 | 7/1998 | Noble et al. | 2/400 |

*Primary Examiner*—Gloria M. Hale

[57] ABSTRACT

An undergarment for separating the testicles from the penis when worn. The inventive device includes a main garment member having a top waist opening, and a pair of spaced apart leg openings. The main garment member has a genital opening located at the front of the main garment member. A cover panel having an outer opening is coupled to the main garment member. The cover panel is positioned on the front of the main garment member such that the cover member covers the genital opening of the main garment member. The cover panel and the front of the main garment member defining a genital space between them. The cover panel also has a pair elongate ducts extending along them with each the duct having opposite upper and lower openings. A testicle pouch having an upper opening and draw string is disposed in the genital space, with each end of the draw string of the testicle pouch extending through one of the ducts of the cover panel from the lower openings of the ducts and out through the upper opening of their associated duct.

6 Claims, 2 Drawing Sheets

FIG. 3
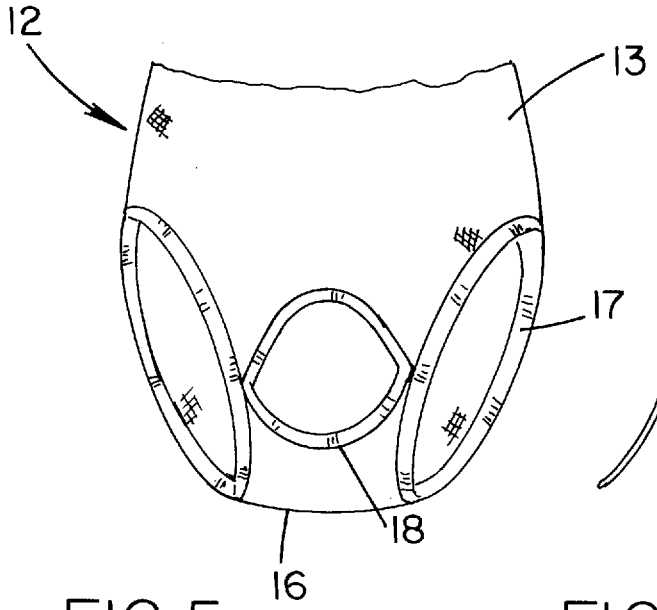
FIG. 4
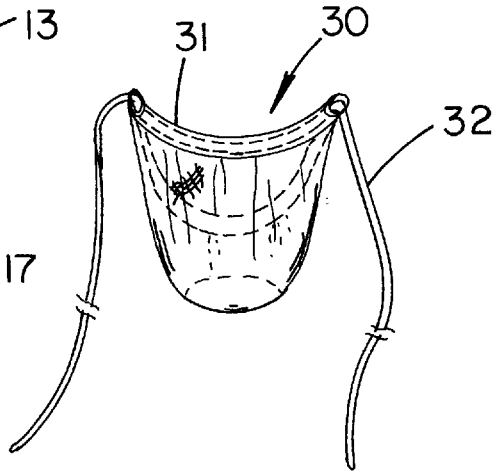
FIG. 5
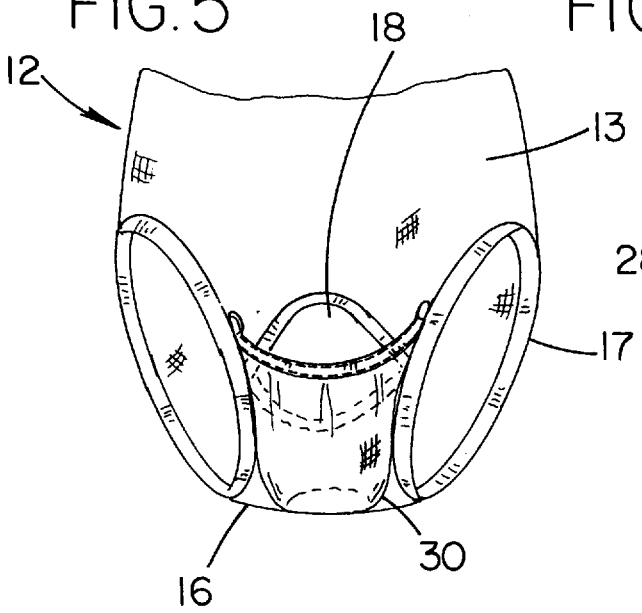
FIG. 6
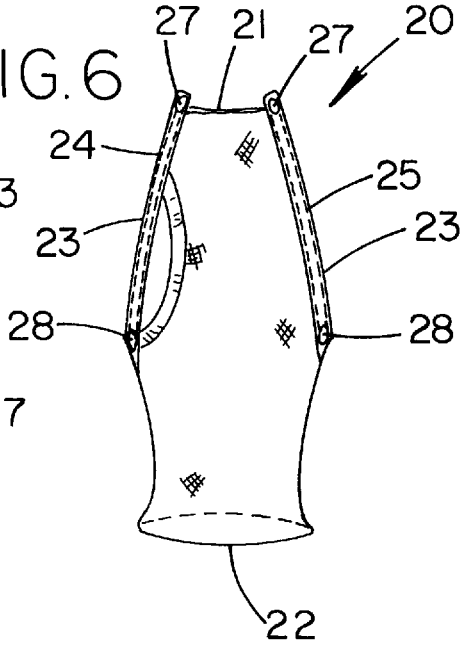
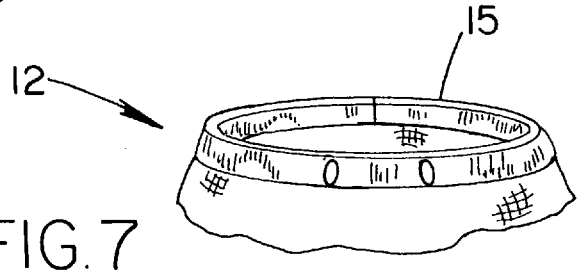
FIG. 7

UNDERGARMENT WITH A TESTICLE POUCH AND GENITAL SPACE

BACKGROUND OF THE INVENTION

1. Field of the Invention

The present invention relates to undergarments for males and more particularly pertains to a new undergarment for separating the testicles from the penis when worn.

2. Description of the Prior Art

The use of undergarments for males is known in the prior art. More specifically, undergarments for males heretofore devised and utilized are known to consist basically of familiar, expected and obvious structural configurations, notwithstanding the myriad of designs encompassed by the crowded prior art which have been developed for the fulfillment of countless objectives and requirements.

Known prior art undergarments for males include U.S. Pat. No. 5,070,869; U.S. Pat. No. 4,961,419; U.S. Pat. No. 4,195,630; U.S. Pat. No. 2,822,807; PCT Patent No. WO 96/03895 (Inventor: Nakamura); and PCT Patent No. WO 94/24973.

While these devices fulfill their respective, particular objectives and requirements, the aforementioned patents do not disclose a new undergarment. The inventive device includes a main garment member having a top waist opening, and a pair of spaced apart leg openings. The main garment member has a genital opening located at the front of the main garment member. A cover panel having an outer opening is coupled to the main garment member. The cover panel is positioned on the front of the main garment member such that the cover member covers the genital opening of the main garment member. The cover panel and the front of the main garment member defining a genital space between them. The cover panel also has a pair elongate ducts extending along them with each the duct having opposite upper and lower openings. A testicle pouch having an upper opening and draw string is disposed in the genital space, with each end of the draw string of the testicle pouch extending through one of the ducts of the cover panel from the lower openings of the ducts and out through the upper opening of their associated duct.

In these respects, the undergarment according to the present invention substantially departs from the conventional concepts and designs of the prior art, and in so doing provides an apparatus primarily developed for the purpose of separating the testicles from the penis when worn.

SUMMARY OF THE INVENTION

In view of the foregoing disadvantages inherent in the known types of undergarments for males now present in the prior art, the present invention provides a new undergarment construction wherein the same can be utilized for separating the testicles from the penis when worn.

The general purpose of the present invention, which will be described subsequently in greater detail, is to provide a new undergarment apparatus and method which has many of the advantages of the undergarments for males mentioned heretofore and many novel features that result in a new undergarment which is not anticipated, rendered obvious, suggested, or even implied by any of the prior art undergarments for males, either alone or in any combination thereof.

To attain this, the present invention generally comprises a main garment member having a top waist opening, and a pair of spaced apart leg openings. The main garment member has a genital opening located at the front of the main garment member. A cover panel having an outer opening is coupled to the main garment member. The cover panel is positioned on the front of the main garment member such that the cover member covers the genital opening of the main garment member. The cover panel and the front of the main garment member defining a genital space between them. The cover panel also has a pair elongate ducts extending along them with each the duct having opposite upper and lower openings. A testicle pouch having an upper opening and draw string is disposed in the genital space, with each end of the draw string of the testicle pouch extending through one of the ducts of the cover panel from the lower openings of the ducts and out through the upper opening of their associated duct.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new undergarment apparatus and method which has many of the advantages of the undergarments for males mentioned heretofore and many novel features that result in a new undergarment which is not anticipated, rendered obvious, suggested, or even implied by any of the prior art undergarments for males, either alone or in any combination thereof.

It is another object of the present invention to provide a new undergarment which may be easily and efficiently manufactured and marketed.

It is a further object of the present invention to provide a new undergarment which is of a durable and reliable construction.

An even further object of the present invention is to provide a new undergarment which is susceptible of a low cost of manufacture with regard to both materials and labor, and which accordingly is then susceptible of low prices of sale to the consuming public, thereby making such undergarment economically available to the buying public.

Still yet another object of the present invention is to provide a new undergarment which provides in the apparatuses and methods of the prior art some of the advantages thereof, while simultaneously overcoming some of the disadvantages normally associated therewith.

Still another object of the present invention is to provide a new undergarment for separating the testicles from the penis when worn.

Yet another object of the present invention is to provide a new undergarment which includes a main garment member having a top waist opening, and a pair of spaced apart leg openings. The main garment member has a genital opening located at the front of the main garment member. A cover panel having an outer opening is coupled to the main garment member. The cover panel is positioned on the front of the main garment member such that the cover member covers the genital opening of the main garment member. The cover panel and the front of the main garment member defining a genital space between them. The cover panel also has a pair elongate ducts extending along them with each the duct having opposite upper and lower openings. A testicle pouch having an upper opening and draw string is disposed in the genital space, with each end of the draw string of the testicle pouch extending through one of the ducts of the cover panel from the lower openings of the ducts and out through the upper opening of their associated duct.

Still yet another object of the present invention is to provide a new undergarment that holds the testicles comfortably.

Even still another object of the present invention is to provide a new undergarment that helps prevent the skin of the testicles from sticking to the skin of the penis.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic front side view of the main garment member of the present invention.

FIG. 4 is a schematic front side view of the testicle pouch of the present invention.

FIG. 5 is a schematic front side view of the present invention showing the positioning of the testicle pouch.

FIG. 6 is a schematic front side view of the cover panel of the present invention.

FIG. 7 is a schematic partial front side view of the top waist opening of the present invention.

DESCRIPTION OF THE PREFERRED EMBODIMENT

Figure 1:
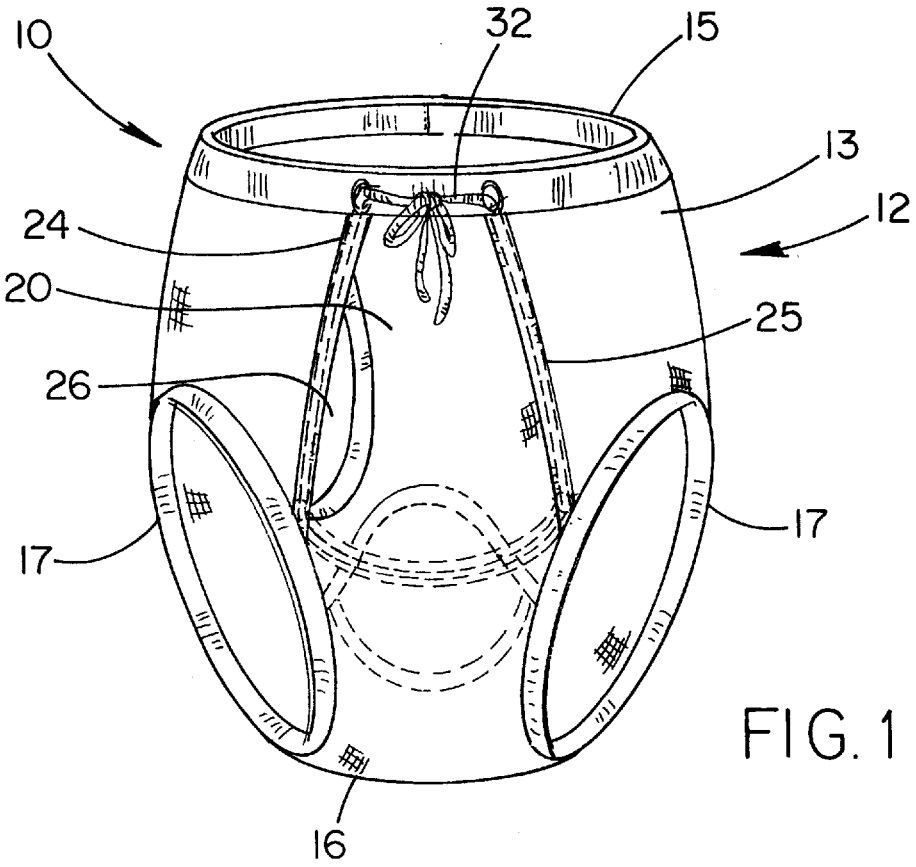
FIG. 1 is a schematic front view of a new undergarment according to the present invention.
Figure 2:
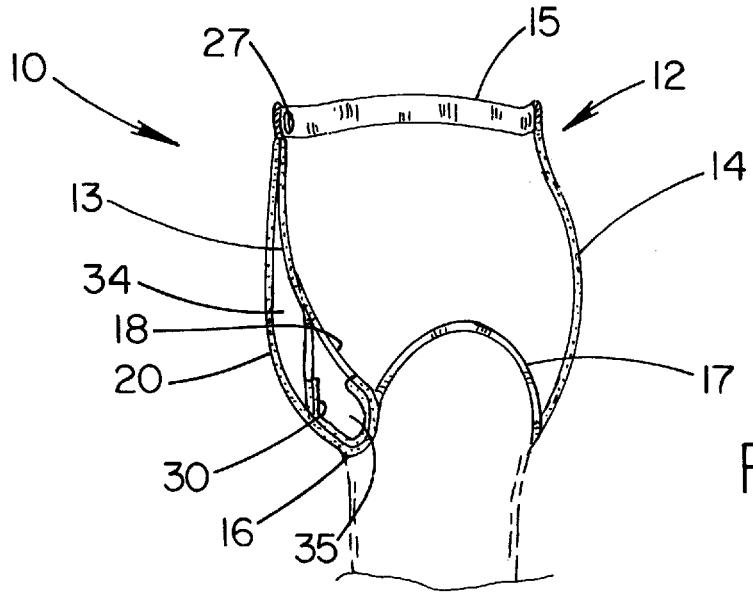
FIG. 2 is a schematic sectional side view of the present invention.

With reference now to the drawings, and in particular to FIGS. 1 through 7 thereof, a new undergarment embodying the principles and concepts of the present invention and generally designated by the reference numeral 10 will be described.

As best illustrated in FIGS. 1 through 7, the undergarment 10 generally comprises a main garment member 12 having a top waist opening 15, and a pair of spaced apart leg openings 17. The main garment member 12 has a genital opening 18 located at the front 13 of the main garment member 12. A cover panel 20 having an outer opening 26 is coupled to the main garment member 12. The cover panel 20 is positioned on the front 13 of the main garment member 12 such that the cover member covers the genital opening 18 of the main garment member 12. The cover panel 20 and the front 13 of the main garment member 12 defining a genital space between them. The cover panel 20 also has a pair elongate ducts 24,25 extending along them with each duct having opposite upper and lower openings 27,28. A testicle pouch 30 having an upper opening 31 and draw string 32 is disposed in the genital space, with each end of the draw string 32 of the testicle pouch 30 extending through one of the ducts 24,25 of the cover panel 20 from the lower openings of the ducts 24,25 and out through the upper opening of their associated duct.

In closer detail, the main garment member 12 has a front 13, a back 14, and a bottom 16 with a top waist band opening 15 and a pair of spaced apart leg openings 17. The leg openings 17 are positioned towards the bottom 16 of the main garment member 12. The main garment member 12 also has a genital opening 18 located at the front 13 of the main garment member 12 between the legs openings of the main garment member 12 and towards the bottom 16 of the main garment member 12. The genital opening 18 is designed for inserting the penis and testicles through it.

The cover panel 20 has upper and lower ends 21,22, and a pair of lateral sides 23 extending between the upper and lower ends 21,22 of the cover panel 20. The upper and lower ends 21,22 and the lateral sides 23 of the cover panel 20 define the cover panel 20 perimeter. The cover panel 20 also has an outer opening 26 designed for extending the penis through it. The perimeter of the cover panel 20 is coupled to the main garment member 12 with the cover panel 20 is positioned on the front 13 of the main garment member 12 such that the cover member covers the genital opening 18 of the main garment member 12. The cover panel 20 is located between the leg openings 17 of the main garment member 12 with the lower end of the cover panel 20 positioned towards the bottom 16 of the main garment member 12 and the upper end 21 of the cover panel 20 positioned towards the upper waist opening of the main garment member 12. A genital space is defined between the cover panel 20 and the front 13 of the main garment member 12. Each of the lateral sides 23 of the cover panel 20 has an elongate duct extending along its length. Each of theses ducts 24,25 has opposite upper and lower openings 27,28 with their upper openings located towards the top waist opening 15 and their lower openings 28 opening into the genital space.

The testicle pouch 30 has an upper opening 31 and a draw string 32 with a pair of opposite ends. The testicle pouch 30 is disposed in the genital space with the upper opening 31 of the testicle pouch 30 facing the top waist opening 15. Optionally, the testicle pouch 30 may be coupled to the main garment member 12, as illustrated in FIG. 5. Each end of the draw string 32 of the testicle pouch 30 extends through one of the ducts 24,25 of the cover panel 20 from the lower openings of the ducts 24,25 and out through the upper opening of its associated duct. The testicle pouch 30 is designed for holding the testicles in it. The draw string 32 permits the lifting and secure holding of testicles in the testicle pouch 30 for added comfort. The testicle pouch 30 divides the genital space into a testicle space 35 and a penis space 34. The testicle pouch 30 defines the testicle space 35 while the penis space 34 is designed for positioning the penis in to be separate from the testicles to help keep the skin of the penis separate from the skin of the testicles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An undergarment, comprising:

a main garment member having a front, a back, a top waist opening, a bottom, and a pair of spaced apart leg openings;

said main garment member having a genital opening being located at said front of said main garment member, said genital opening being positioned between said leg openings of said main garment member;

a cover panel having an outer opening;

said cover panel being coupled to said main garment member, said cover panel being positioned on said front of said main garment member such that said cover member covers said genital opening of said main garment member;

said cover panel and said front of said main garment member defining a genital space therebetween;

said cover panel having a pair of elongate ducts extending therealong, each of said ducts having opposite upper and lower openings, said upper openings of said ducts being located towards said top waist opening, said lower openings of said ducts opening into said genital space; and a testicle pouch having an upper opening and draw string having a pair of opposite ends, said testicle pouch being disposed in said genital space, each end of said draw string of said testicle pouch being extended through one of said ducts of said cover panel from said lower openings of said ducts, said ends of said draw string being extended through the upper opening of its associated duct.

2. The undergarment of claim 1, wherein said genital opening is located towards said bottom of said main garment member.

3. The undergarment of claim 1, wherein said cover panel has upper and lower ends, and a pair of lateral sides extending between said upper and lower ends of said cover panel, said upper and lower ends and said lateral sides of said cover panel defining a cover panel perimeter, and wherein said perimeter of said cover panel is coupled to said main garment member.

4. The undergarment of claim 3, wherein said lower end of said cover panel is positioned towards said bottom of said main garment member, and said upper end of said cover panel is positioned towards said upper waist opening of said main garment member.

5. The undergarment of claim 3, wherein each of said lateral sides of said cover panel has one of said elongate ducts extending therealong.

6. An undergarment, comprising:

a main garment member having a front, a back, a top waist opening, a bottom, and a pair of spaced apart leg openings, said leg openings being positioned towards said bottom of said main garment member;

said main garment member having a genital opening being located at said front of said main garment member and towards said bottom of said main garment member, said genital opening being positioned between said leg openings of said main garment member;

a cover panel having upper and lower ends, and a pair of lateral sides extending between said upper and lower ends of said cover panel, said upper and lower ends and said lateral sides of said cover panel defining a cover panel perimeter, said cover panel having an outer opening;

said perimeter of said cover panel being coupled to said main garment member, said cover panel being positioned on said front of said main garment member such that said cover member covers said genital opening of said main garment member, said cover panel being located between said leg openings of said main garment member, said lower end of said cover panel being positioned towards said bottom of said main garment member, said upper end of said cover panel being positioned towards said upper waist opening of said main garment member;

said cover panel and said front of said main garment member defining a genital space therebetween;

each of said lateral sides of said cover panel having an elongate duct extending therealong, each of said ducts having opposite upper and lower openings, said upper openings of said ducts being located towards said top waist opening, said lower openings of said ducts opening into said genital space; and a testicle pouch having an upper opening and draw string having a pair of opposite ends, said testicle pouch being disposed in said genital space, said upper opening of said testicle pouch facing said top waist opening, each end of said draw string of said testicle pouch being extended through one of said ducts of said cover panel from said lower openings of said ducts, said ends of said draw string being extended through the upper opening of its associated duct.

* * * * *